United States Patent [19]

Ishibe

[11] Patent Number: 4,830,262

[45] Date of Patent: May 16, 1989

[54] METHOD OF MAKING TITANIUM-NICKEL ALLOYS BY CONSOLIDATION OF COMPOUND MATERIAL

[75] Inventor: Hideomi Ishibe, Osaka, Japan

[73] Assignee: Nippon Seisen Co., Ltd., Osaka, Japan

[21] Appl. No.: 932,339

[22] Filed: Nov. 19, 1986

[30] Foreign Application Priority Data

| | | | |
|---|---|---|---|
| Nov. 19, 1985 | [JP] | Japan | 60-260844 |
| Jun. 13, 1986 | [JP] | Japan | 61-138495 |
| Jun. 16, 1986 | [JP] | Japan | 61-141108 |
| Jun. 17, 1986 | [JP] | Japan | 61-142187 |

[51] Int. Cl.[4] ..... C22B 7/00

[52] U.S. Cl. ..... 228/156; 228/173.2; 228/231; 148/11.5 Q

[58] Field of Search ..... 228/159, 190, 231, 156; 148/11.5 N, 11.5 Q, 402

[56] References Cited

U.S. PATENT DOCUMENTS

| | | | |
|---|---|---|---|
| 3,465,430 | 9/1969 | Barber et al. | 228/156 X |
| 3,523,354 | 8/1970 | Loewenstein | 228/159 |
| 4,279,121 | 7/1981 | Ryan et al. | 228/56.3 X |
| 4,411,712 | 10/1983 | Marancik | 148/11.5 Q |

FOREIGN PATENT DOCUMENTS

| | | |
|---|---|---|
| 116340 | of 1984 | Japan . |
| 177345 | 8/1986 | Japan . |

*Primary Examiner*—Kenneth J. Ramsey

*Attorney, Agent, or Firm*—Birch, Stewart, Kolasch & Birch

[57] ABSTRACT

A method of making TiNi alloys is disclosed. The process includes forming a composite by providing in a sheathing container plural pieces of compound wire having Ti lineal wire made of Ti material and Ni material made to contact at least a portion of the surface of the Ti lineal wire. The composite is then subject to dimension-reduction, after which diffusion is effected to cause the production of a TiNi phase. The composite is removed from the sheathing container and cold-worked.

10 Claims, 12 Drawing Sheets

(X400)

(X400)

(X200)

(X200)

(X200)

(X200)

(X 200)

(X200)

METHOD OF MAKING TITANIUM-NICKEL ALLOYS BY CONSOLIDATION OF COMPOUND MATERIAL

BACKGROUND OF THE INVENTION

1. Field of the Invention

The present invention relates to a method of manufacturing TiNi-alloys, compound material used therein and TiNi-alloys, and in particular, to a method of manufacturing TiNi-alloys having a homogeneous composition, which can be used for, for example, shape-memory alloys or superelastic alloys.

2. Background of the Invention

TiNi-alloys have various functions such as a shape-memorizing effects, superelastic behavior, or an oscillation-proof effects. Therefore, they are perceived as having the ability to be used for a wide range of purposes.

Heretofore, however, in order to develop such kinds of TiNi-alloys, like general alloys, they have been manufactured through many processes such as hot working, cold working, and heat treatment of ingots obtained by melting titanium together with nickel until they become wire rods of a desired size, and further conducting on them an after-treatment (for example, a heat treatment) with the object of imparting a shape-memorizing or similar effect to them.

In such manufacturing methods, it is difficult not only to control the composition of titanium with nickel at the time of melting, that it is also hard to obtain the product of a homogeneous distribution of the composition because of the use of the Ti material which is likely to oxidize. There also is another defect because impurities such as oxygen, carbon, or other gases can mix into the composition of the time of melting.

Consequently, as shown in FIG. 32 (illustrated hereinafter), in the product obtained by the conventional melting process many impurities (such as oxides presenting an appearance of black spots) are scattered and they exert a bad influence upon the performance of the TiNi-alloys. By way of example, in the shape-memory alloy, even when modifying an Ni-composition only by 0.1%, its transformation point varies sharply, in conjunction with which its working temperature also is changed. Therefore, the change of the composition rate due to the above-mentioned oxidation becomes a big problem.

Further, it is impossible, at the diameter-reducing step, that a high degree of work is needed because the TiNi-alloy is hard to work, as a result of which many processes are required for producing a wire smaller than 1 mm in diameter, thereby incurring some disadvantages such as poor productivity, high costs, or others.

The powder metallurgy method has been known as another method for making TiNi-alloys wherein Ti powder and Ni powder are mixed at suitable range and are sintered by heat treating diffusion. However, in this method, since the powder has a large surface area and the oxide layer formed at the surface of the Ti power (which is apt to oxidize) is converted to an oxide of Ti Ni O, there occur problems such as the alteration of the transformation point and the diminution of strength and life due to the voids formed in the TiNi-alloys.

To solve some of the above-mentioned difficulties, there is proposed in Japanese Patent Application Disclosure No. 116340 of 1984 a method of obtaining the TiNi phase (Nitinol) by making Ti and Ni adhere closely through pressure or metal plating and making them diffuse by heating.

In this method, however, the diffusing velocity is slow, whereas a lot of time is required for producing a large-diameter article. For instance, even in order to obtain a wire of about 0.5 to 1 mm in diameter which is much in demand, it is necessary to take a long time, exceeding 100 hours of the diffusive heat treatment. As a result, this method also is not very practical.

In view of the above, the exhaustive utilization of the TiNi-alloy has not been contemplated in the past for all its many functions and excellent properties.

Although the TiNi-alloys surpass other high-performance material such as CuZn-alloys and CuAlZn-alloys, there has developed a need for better properties in TiNi-alloys.

Under these circumstances, the present invention has been completed by discovering that the difficulties of the prior art could be overcome by conducting a diameter-reducing working procedure and a diffusing process after a plurality of compound wires, assembled by making Ti wire rods contact the Ni material, are inserted into a sheathing element.

SUMMARY OF THE INVENTION

Accordingly, it is an object of the present invention to provide a method having the ability to produce TiNi-alloys excellent in homogeneous properties, by which method the productivity is to be elevated and the cost to be lowered.

DETAILED DESCRIPTION OF THE INVENTION

Figure 1:
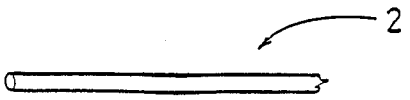
FIG. 1 is a perspective view showing schematically a Ti-lineal element being used in the method according to the invention.

The manufacturing method of the TiNi-alloy in accordance with the invention is characterized in that there is formed a composite 9 in which a plurality of compound wires 6 are disposed in a sheathing element 7. The compound wire 6 consists of Ti lineal element 2 and Ni material 3 that is made to touch at least a part of the surface of the Ti lineal element 2, while the composite 9 is subject to a diameter-reducing process and the diffusing process in the container 11, providing a TiNi phase. The sheathing element 7 is removed as desired from the composite 9 thereafter.

Although, in general, the Ti-lineal element 2 is a small-diameter wire rod made up of pure titanium, it may be possible to utilize as a substitute for the pure Ti-lineal element such Ti-alloys containing or being covered with Cu, V, Mo, Al, Fe, Cr, Co and other materials, with a view toward improving many properties such as the transformation point in the final product, the mechanical properties, the workability, and others. Further, it is also desirable that the lineal element 2 may be enhanced in regard to its contact with the Ni-material 3 by forming its own cross-section, not only circular but also non-circular. On the other hand, there is used for the Ni-material (in addition to pure Ni) Ni-alloys containing or being covered with various kinds of other material such as mentioned above.

Figure 2:
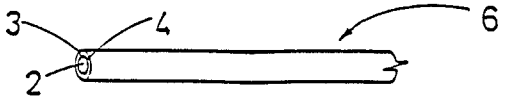
FIG. 2 is a perspective view illustrating an exemplary compound wire.

FIG. 2 shows an example of the compound wire in which the Ni material 3 is made to contact the whole surface of the Ti-lineal element 3 by employing the covering stuff 4 covering the Ti lineal element 2.

Figure 10:
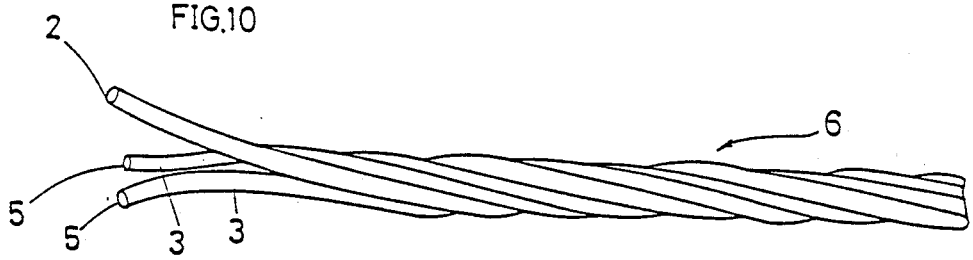
FIG. 10 is a perspective view showing another example of the compound wire.

FIG. 10 shows another compound wire 6 in which the Ni material being formed in a shape of the wire is made to contact a part of the surface of the Ti lineal element 2 by twisting it together with the Ti lineal element 2.

The NiTi composition ratio of the compound wire 6 is within the limit of Ni 45 to 60% and Ti 55 to 40% or less. If desired, one or more of the third elements described above may be included.

As for the compound wire 6 shown in FIG. 2, in which the Ni material is used as a covering 4, it is indeed possible to form the covering 4 surrounding the Ti lineal element 2, for example, by a cladding process by which the Ni material 3 such as a pipe material or a tape material is laid on the surface of the Ti lineal element 2, or by a melt-jetting process, an evaporating process, or a plating process. In particular, the coating 4 formed by means of galvanoplasty is preferable from the viewpoint of equipment, productivity, and covering precision.

In such a case, it is possible to have for the Ti lineal element 2 ordinarily a diameter of about 0.05 to 5 mm. However, in the case of forming the covering element 4 by using galvanoplasty, an element of about 0.2 to 2 mm in diameter can be preferably used for the purpose of above all enhancing the workability and the productivity.

If the linear diameter of the Ti-lineal element 2 is too high, the amount of the plating of the Ni also naturally grows bigger, and it requires much time for the plating work. If the diameter is too small, it becomes inferior in workability, because in the manufacturing method of the TiNi-alloys according to this invention, it is necessary to regulate in advance the composition rate of the Ti material to the Ni material in the compound wire. The products having the above-mentioned value are available on the market.

Figure 3:
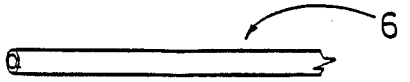
FIG. 3 is a perspective view of a pre-drawn and diameter-reduced compound wire of FIG. 2.
Figure 4:
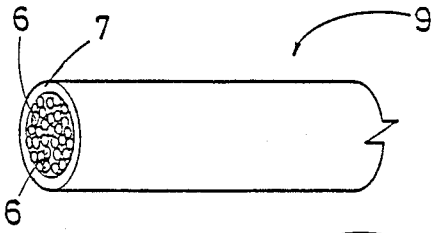
FIG. 4 is a perspective view illustrating a composite.
Figure 20:
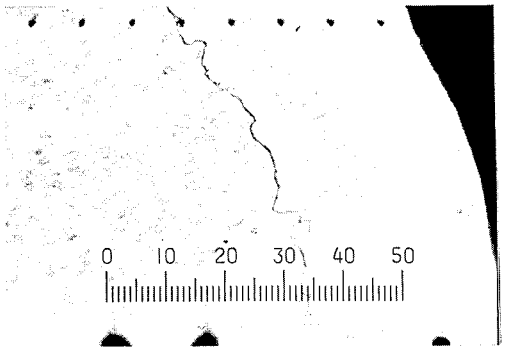
FIG. 20 is a microphotograph showing the metal tissue of the compound wire body which is formed of the Ti lineal element being Ni metal-plated.

At the time of the plating treatment, it is desired especially that the scales or the impurities on the surface of the Ti-lineal element 3 are removed beforehand, and, if necessary, it is also desirable to elevate the degree of the close adhesion of the Ti-lineal element 2 to the Ni-material 3 after the above-mentioned covering treatment, and further to conduct a preparatory wire-stretching treatment (shown in FIG. 3) to a slight degree to crush voids such as seen in FIG. 20. In this case, the above-mentioned Ni material 3 functions also as a lubricant to elevate its natural workability, and further is able to repress the oxidation of the internal Ti lineal element 2.

It is also possible by the method of this invention to form compound wire in the shape of tape by laminating tape-shaped Ni material 3 on the likewise tape-shaped Ti lineal wire successively on one surface or on both surfaces thereof.

In the case of the compound wire in which the Ni material is utilized as a Ni lineal wire as shown in FIG. 10, the Ti lineal element 2 twisted together with the Ni lineal element 5, elements having a smaller diameter, for example, ones of 0.1 to 1 mm in diameter, can be used conveniently on the same ground.

When the linear diameter of the Ti lineal element 2 is not too great, the state of twisting together with Ni lineal element 5 is not good, as a result of which the number of the working steps is increased at the time of the diameter-reducing working, so that the productivity is impeded greatly. When the lineal diameter is too small, there is likely to occur the breaking of the wire rod against the twisting work, and not only that, the wire of such a small diameter is inferior in productivity by comparison, thereby entailing an increase in cost. On the other hand, as the Ni lineal element 5 used in intertwisting, a wire with a linear diameter of the same size as the above Ti lineal element 2 can be used.

When twisting together the Ti lineal element 2 and the Ni lineal element 5, the respective thickness or diameter and number of pieces of them are set preparatorily so as to be able to obtain a preferable tissue rate of titanium to nickel. For example, if the TiNi alloy of 50% is to be obtained by Ni as a stoichiometric composition, when the diameter of the Ti lineal element 2 is 0.187 mm and the diameter of the Ni lineal element 5 is 0.2 mm, then the ratio of their number of pieces to each other is set at 2:1, and when they are of the nearly same diameter, their ratio of 3:2 or the like is set. Of course, the above-mentioned composition ratio can be set as one desires, depending upon the equilibrium of the required shape-memory property and others, but in general it is practiced almost within the limits of Ni of 45 to 60% and Ti 55 to 40% or less when the TiNI phase is able to be produced.

By the method according to this invention, one is able to obtain easily and accurately an alloy of a desired composition ratio by regulating the composition ratio and the combination of titanium to and with nickel in the compound wire 6. As the number of inserted pieces is increased and their lineal diameter is decreased, homogeneity is enhanced even more.

It is preferable that the number of times of the twisting work is confined to the extent of about 0.5 to 5 times per inch for preventing the breaking of wires at the time of the subsequent diameter-reducing working and from the viewpoint of the convenience of the inserting into the sheathing element 7. Furthermore, the number of Ti lineal wires and Ni lineal wires as well as the twisting are suitably selected.

As described above, the compound wires containing the Ni materials are made to contact at least a part of the surface of the Ti lineal wire 2, by covering or twisting as shown in FIGS. 2 and 10. Further, when inserting a plurality of such compound wires 6 into, for example, the cylinder-shaped sheathing element 7, then there is formed one composite 9.

As for the sheathing element 7, it is possible to apply, for example, some cylindrical body such as a pipe material or a hoop wound material which is made up of various kinds of metals, easy to be plastically deformed, for example, such as Monel metal, copper, soft steel, nickel, or the like. It is also preferable to conduct the Ni plating beforehand on the inner face thereof, thereby preventing diffusion from the sheating element 7 to the compound wire 6 at the time of the diffusion process, and vice versa.

The cross-sectional form and size of the sheathing element 7 is selected by preference. However, these factors are decided in view of the productivity and the quality of the product in the course of the diameter-reducing working and the diffusing process on the basis of the initial linear diameter, the number of pieces, and the diameter of the final product of the compound wire 6 to be inserted into the sheathing element 7.

Figure 5:
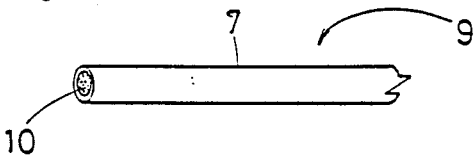
FIG. 5 is a perspective view illustrating the composite having been through a diameter-reducing working and having a compound material therein.
Figure 6:
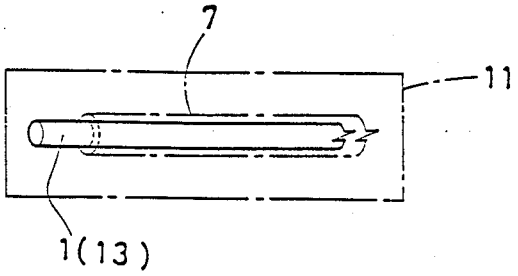
FIG. 6 is a perspective view exemplifying a diffusion step.

Next, the composite 9 is then drawn by conducting cold drawing, swaging working, rolling working, extruding working, or types of procedures on the composite 9 so as to obtain the final size and form, wherein the Ti lineal wires have the desired final fibrous diameter such as less than 0.1 mm as shown in FIG. 5.

Figure 14:
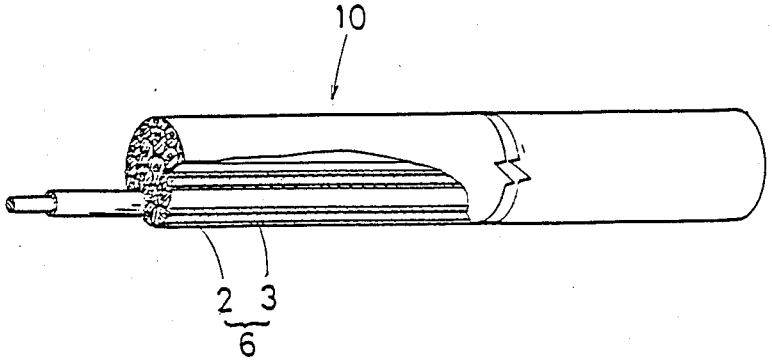
FIG. 14 is a perspective view showing by example a compound material of the invention.
Figure 16:
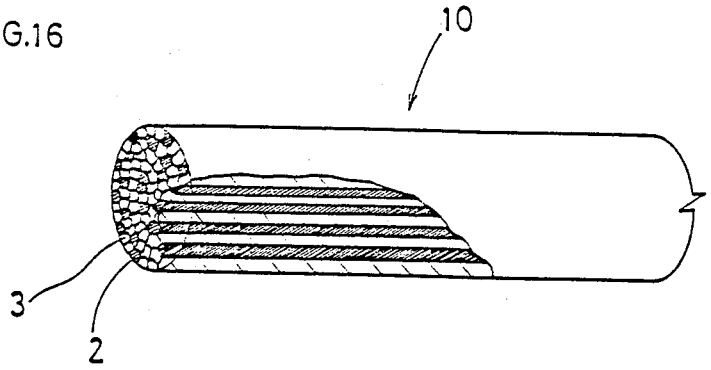
FIGS. 16 through 17 are respective views showing another compound material.
Figure 17:
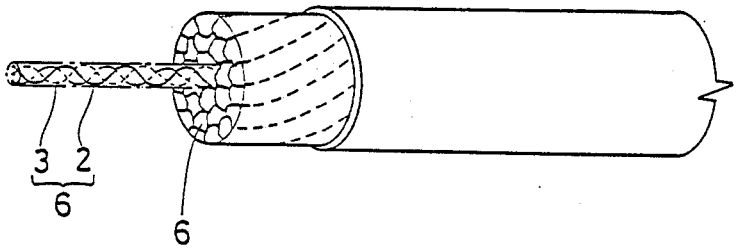
Figure 18:
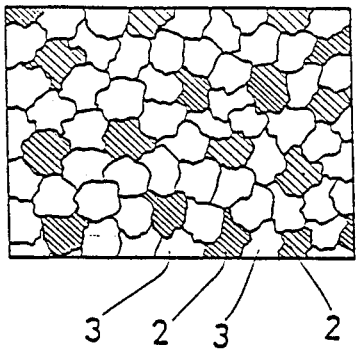
FIG. 18 is a transverse cross-section of the compound material shown in FIG. 16.

According to the diameter reduction of the composite 9 through the drawing steps, the compound wires 6 are also drawn down to the preselected diameter and mechanically bonded to each other at the surfaces thereof, so that there is formed the compound material 10 as shown in FIGS. 14, 16, and 17. The compound material 10 is banded together to such a degree as to be able to maintain a unit after the removal of the sheathing element 7. Fine unevenness is formed on the surface of the Ti lineal wire 2 and Ni material 3, which may increase the mechanical bonding strength. Also, the compound material 10 formed of compound wires 6 has a homogeneous composition ratio through the full length and is able to be drawn down to an approximately final shape and dimension due to its facility of deformation.

Figure 15:
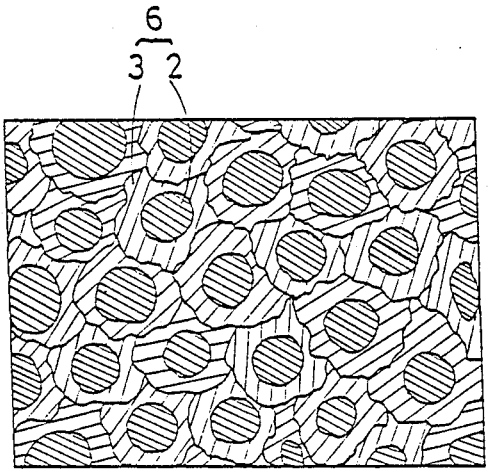
FIG. 15 is a transverse cross-section of the compound material shown in FIG. 14.
Figure 21:
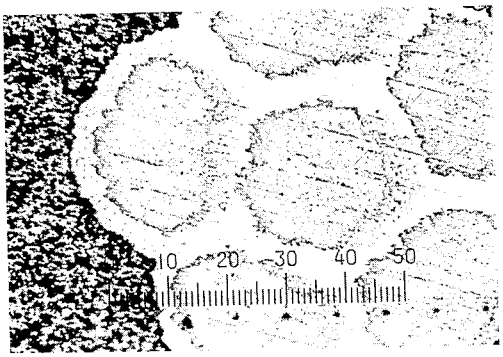
FIGS. 21 and 22 are microphotographs showing the respective metal tissues of each compound material.
Figure 22:
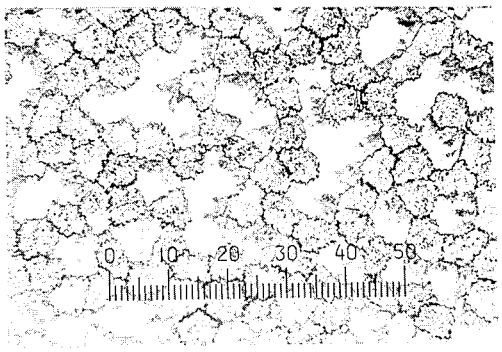

FIGS. 14, 15 and 21 show the compound material 10 formed by plating and FIGS. 16, 17 and 22 show the same one formed by twisting, respectively, while being based on the working process as mentioned above.

As shown in FIG. 21 and FIG. 22, it is clear that the Ti lineal element 2 and the Ni material both become small in diameter and adhere closely to each other, thus preventing a contact gap.

Such a diameter-reducing working is conducted at the working rate of more than 50%, and, if necessary, in the course of the above-mentioned diameter-reducing working, the annealing process is conductd at low temperature or in a short period of time. By conducting the diameter-reducing working on both (the Ti lineal element 2 and the Ni material 3) so as to become fibriform, it becomes possible to shorten the heating time of the subsequent diffusing process by a large margin and to flatten the surface of the product, thereby heightening the value thereof.

Figure 19:
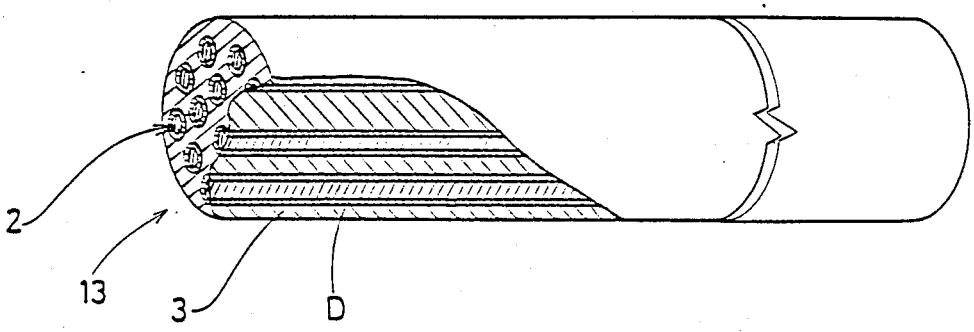
FIG. 19 is a perspective view showing by example a diffused compound material.

Following the diameter-reducing working, the diffusing process is conducted on the diameter-reduced composite 9 while heating within the limits of, for example, 700° to 1100° C., whereby the compound wire 6 having TiNi changes into the TiNi phase as a chemical compound. The diffusion is a mutual phenomenon which occurs in view of the fact that the Ti atoms shift to the Ni side, on the one hand, and on the other, the Ni atoms shift to the Ti side, respectively. Therefore, to make this reaction complete in a short time, it is preferable to shorten the shifting distance as much as possible, whereby the thus diameter-reduced Ti lineal element 2 and Ni material 3 can be made to diffuse in a short time, while the diffused compound material 13 shown in FIG. 19 having a homogeneous TiNi phase is produced inside the sheathing 7 by the compound material 10. The diffused compound material 13 is easily removed from the sheathing element 7 and the diffused material 13 is diffused perfectly turned to the TiNi alloy 1.

Figure 23A:
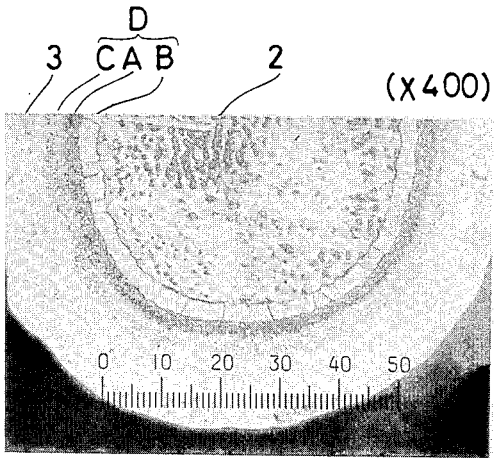
FIGS. 23(*a*) and 23(*b*) are microphotographs illustrating by example the respective metal tissues after the diffusing working.
Figure 23B:
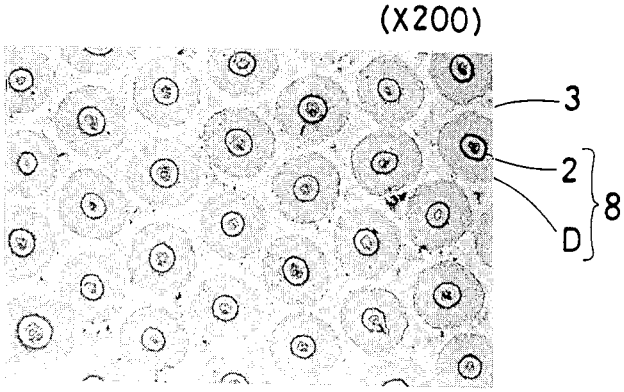

In this connection, when the diffusing reaction is insufficient because the heating time is too short, then not only the TiNi phase A but also the $TiNi_3$ phase C, $Ti_2Ni$ phase B, Ni phase E, and Ti phase D sometimes remain behind as they are, as shown in FIG. 23(*a*), in the case in which the compound wire was formed, for example, by plating. In such a case, the present invention is also able to select the conditions for treating them depending on the object. On the other hand, FIG. 23(*b*) shows the state wherein the diffusing treatment at 900° C. for 1 hour has been conducted after the diameter-reducing working step on the composite 9 which is made up by bundling a plurality Ni-plated TiNi wire bodies 6, but here it is clear that the diffusion is not yet finished completely.

The diffused compound material 13 has an undiffused Ti base material 8 in which the Ti materials 2 are surrounded by the diffused layer D (A, B, and C) and is separated from each other by the Ni material 3. The Ti base materials 8 are disposed uniformly and are one body with the Ni material 3. The diffused layer D is increased in thickness according to the degree of the diffusion treatment. Also, the thickness of the layer D is small, less than several μmm, in the early diffusing stage.

It is desirable that the heating treatment is conducted at the same temperature, but also it does not matter if the treatment is conducted while varying the temperature in stages.

According to experiments of the invention, it was found that there are formed at a heating temperature of 900° C. a TiNi phase of 40 μm in thickness through 2 hours treatment, but a TiNi phase of 70 μm in thickness through 10 hours treatment. If the Ti lineal element 2 is made minutely, for example, up to 70 μm, it is possible theoretically that 5 hours of heating time will suffice to make the Ti lineal element 2 diffuse. In this case, it goes without saying that there are some differences among the diffusing times required depending on the temperatures.

Practically, though in this state, the surface of the diffused compound material 13 is covered with the sheathing element 7 and is insufficient in its function. Therefore, it is desired that the sheathing element 7 is removed therefrom by using a chemical method or a mechanical method, for example, such as a cutting method, in the course of the diffusing process or after the same process.

If necessary, it is possible to conduct various kinds of after-treatments such as cold working, polishing working, or a solution heat treatment for the purpose of enhancing the properties of the surface and promoting the homogeneity of the tissue. Finally, for example, when intending to obtain shape-memorization, it becomes possible to obtain the product desired first by forming it into the prescribed form (for example, a spring-shape) and then by heat-treating it at about 400° to 500° C. In the case of a super-elastic alloy, the working is enabled by changing, for example, the Ni composition ratio and by lowering the transformation point near a sub-zero temperature, which will be made possible on the basis of the utilization of this invention.

The TiNi-alloys can be obtained by the method of this invention are not limited only to circular forms, but also can correspond to non-circular forms such as, for example, elliptic shapes, square shapes, plates and other deformed shapes, and further they have applicability to all descriptions of sizes covering a wide range from very small to large.

Discussion will be now directed to the method of making the TiNi alloy having one or more third elements selected from the group consisting essentially of Cu, V, Mo, Cr, Al, Fe, Co and so on.

Figure 11:
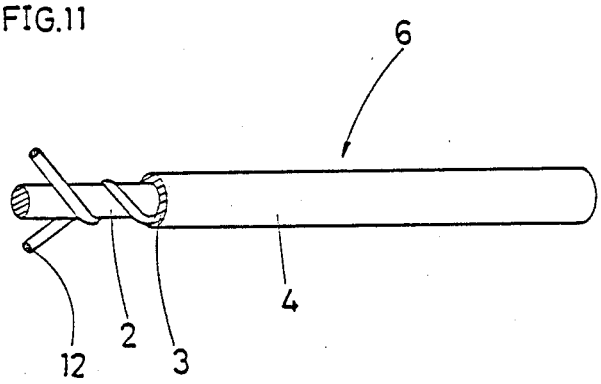
FIGS. 11 through 13 are respective views showing still further examples of the compound wire.

FIG. 11 shows an example wherein the Ti lineal wire 2 intertwisted by the third element lineal wire 12 is wrapped by the covering 4 formed of Ni material 3.

Figure 12:
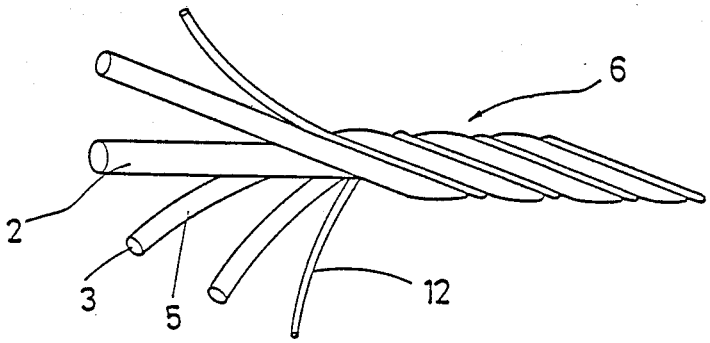
Figure 13:
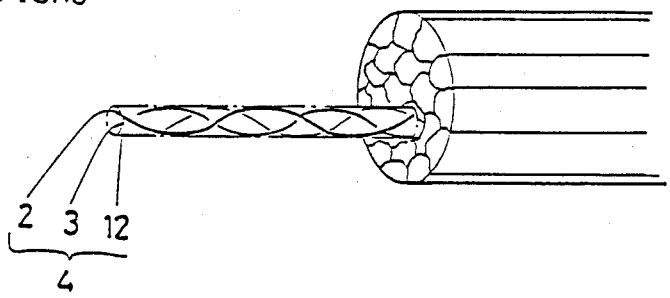

FIGS. 12 and 13 are schematic drawings to explain embodiments wherein, as is seen in the figures, the compound wire 6 substantially surrounding the Ti lineal element 2 is obtained by intertwisting the Ni lineal element 5 made of the Ni materials 3 and the third element lineal elements 12 around the Ti lineal element 2 arranged in the center.

Applied to the Ti lineal element 2 and the Ni lineal elements 5 in this case are respectively lineal elements made of pure metals thereof, while there are used the third element lineal elements 12 which have been found so as to be substituted with less than 5% of the final TiNi alloy product selected from the group of the third elements.

As for the diameter of the above-mentioned third element lineal element 12, it is desirable to use many small elements, for example, ones about 0.05 to 0.8 mm in diameter. They are to be arranged so as to be scattered in the TiNi wire body 6 as well as the compound material 10 as uniformly as possible.

The composite 9 is able to be treated in the following manner so as to obtain the alloy having the TiNi phase through the same treatment as in the first invention.

Although the above-mentioned third elements are selected in consideration of the regulation of the transformation point and the improvement of its mechanical properties, and in accordance with the other desired objects, it is undesirable if their composition ratios exceed 5% because of lowering of the workability.

Figure 7:
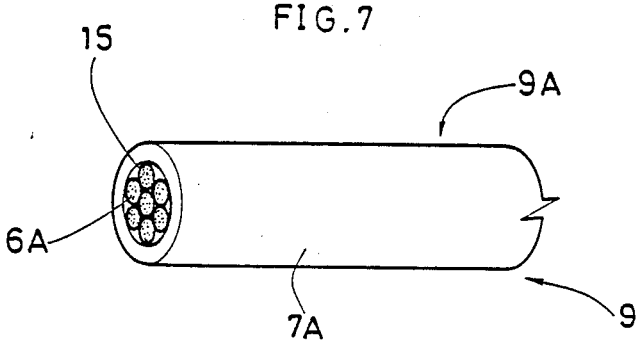
FIG. 7 is a perspective view showing a secondary composite wherein the compound materials shown in FIG. 5 are installed in a secondary sheathing element.
Figure 8:
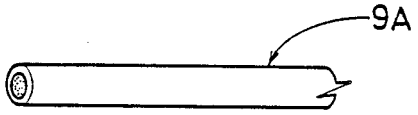
FIG. 8 is a perspective view showing a diameter-reduced secondary composite by drawn working.
Figure 9:
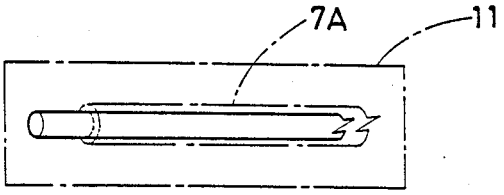
FIG. 9 is a perspective view exemplifying a diffusion step.

As shown in FIGS. 7 through 9, the compound material 10 obtained by the process illustrated in FIGS. 1 through 6 is available for use as the wire 6A corresponding to the compound wire 6 shown in FIGS. 1, 10, 11 and 12.

The compound material 10 is released from the sheathing element 7 of the composite 9 by suitable means such as a selective chemical attack of the sheathing element 7. The sheathing 7 may be removed by another means, for example, mechanical removal, or electrochemical dissolution. The compound material 10 thus obtained has a diameter of, e.g., about 0.64 mm and is as one body due to the mechanical bonding between the compound wires 6.

Further, when the sheathing element 7 is removed by acid such as a hot nitric acid fluid, the Ni material 3 is apt to be solved away from the surface of the compound material 10, thereby the surplus layer 15 wherein the Ti element is more rich than internal tissue is formed. The compound material 10 is released from the sheathing element 7 by mechanical means may be provided with the surplus layer 15 of Ni, by plating the Ni material therearound as the lubricant. The TiNi alloy per se is also available as a material 6A, and the Ni coating is generally adopted for the lubricant.

One hundred twenty (120) of the compound materials 10 are disposed in the secondary sheathing element 7A, and thereby the secondary composite 9A is formed. The composite 9A is drawn down to the final small dimension as shown in FIG. 8. As a result, the material 6A is allowed to grow small in diameter and the void therein is eliminated. Such a diameter-reducing process is conducted at the working rate of about 50%.

Figure 24:
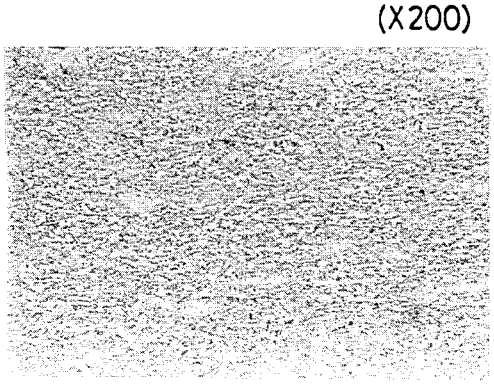
FIG. 24 is a microphotograph showing the metal tissue of a compound material which has been through the secondary diameter-reducing working.

In FIG. 24 is shown a microphotograph of the cross section of the secondary compound material manufactured as described above and corroded by a suitable corrosive agent. It is seen that the Ti material and the Ni material are dispersed uniformly, since the boundary between them is quite obscure.

Figure 25:
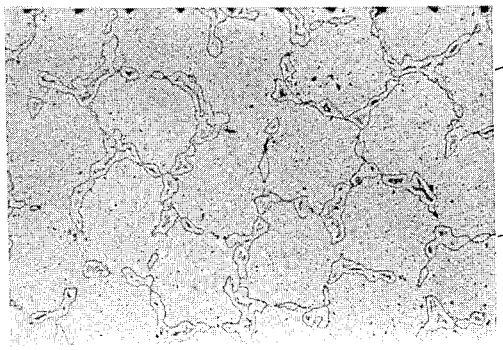
FIG. 25 is a microphotograph showing a metal tissue of the compound material shown in FIG. 24 which is diffused imperfectly.
Figure 26:
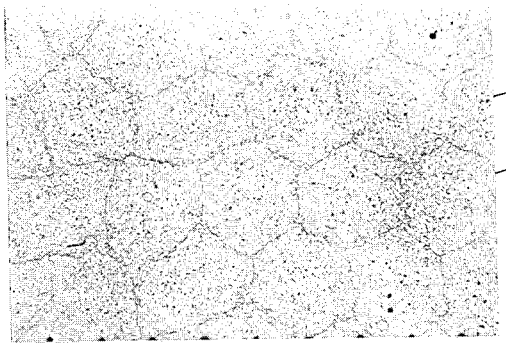
FIG. 26 is a microphotograph showing a metal tissue in cross-section of the compound material shown in FIG. 24 which is diffused.
Figure 27:
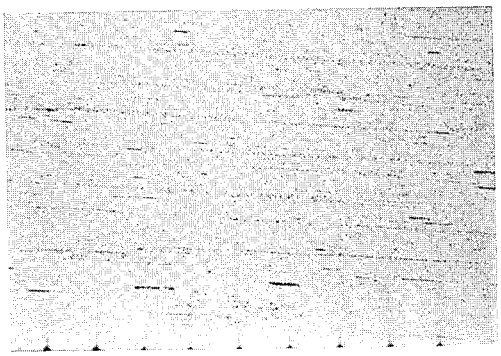
FIG. 27 is a microphotograph showing a longitudinal metal tissue of the compound material of FIG. 26.
Figure 28:
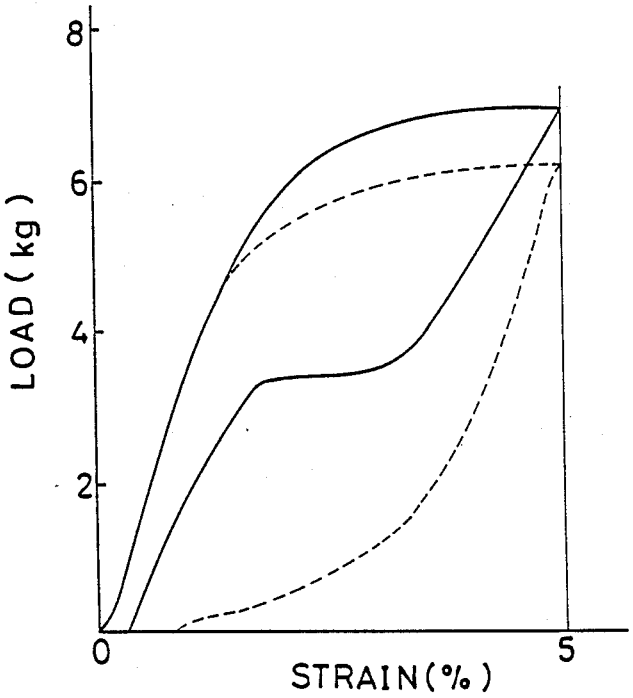
FIG. 28 is a graphical representation showing the relationship between the strength and the strain of NiTi-alloy obtained in the method of the invention.

The diffusing process is conducted on the secondary composite 9A. FIG. 25 is a microphotograph in two centuples showing the transverse section of the secondary compound material which is not well diffused. It is seen that the intermittent reinforcing layer 17 is extending in a netlike configuration through the base 16 comprising the Ti material and the Ni material which are partially diffused. FIG. 26 is a microphotograph in two centuples showing the tissue in cross section of the secondary compound material which is diffused enough. FIG. 27 is that of the tissue thereof in a longitudinal section. As illustrated in FIG. 26, the reinforcing layer 17 decreases the thickness thereof and almost continuously extends hexagonal-netlike through the base 16 where the Ti material and the Ni material are diffused. The reinforcing layer 17 also extends longitudinally.

The reinforcing layer 17 is supposed to be formed from the $Ti_2Ni$ if the surplus layer 15 is rich in Ti and $TiNi_3$ if the surplus layer 15 is rich in Ni as mentioned before. Also, the concentration is presumed to change gradually in the layer 17. Although $TiNi_3$ and $Ni_2Ti$ are metal compounds made from Ni and Ti similar to the base 16, the $TiNi_3$ and $Ti_2Ni$ are harder and more difficult to work than the base 16. For example, the hardness of the $TiNi_3$ comprising 73 through 78 Ni % is of Hv 400 through 500. Consequently, it is quite important to control the volume ratio of the reinforcing layer 17 to avoid deterioration thereof, and the ratio should be selected in accordance with the desired objects and properties.

Additionally, another material, for example, a ceramic powder or metallic oxide such as $TiO_2$, $Al_2O_3$, $Cr_2O_3$ which may not chemically affect the TiNi phase is also available to form the reinforcing layer 17. The powder may be applied on the body comprising the compound wire 6, compound material 10 or the wire of TiNi alloys by spraying, painting with a brush, or other means. The reinforcing layer 17 similar to that made from Ti and Ni is formed by reducing the diameter of the composite in which a plurality of the body is disposed in the sheathing element. The reinforcing layer 17 extended netlike may be formed if the powder is applied throughout the circumference of the body, and also the layer 17 may be extended in a longitudinal direction intermittently or continuously. When the powder is applied only longitudinally passing through a portion of the circumference of the body, the layer 17 running in the longitudinal direction may be obtained. Due to the secondary diameter-reducing process, the Ti lineal wire 2 is reduced in diameter down to less than 5 μm, thereby enabling reduction of the time necessary for the diffusing step. The elongated body turns to the TiNi alloy through the diffusing step and removing step. The heating treatment for diffusion may be done at the same temperature, but also it does not matter that the temperature may vary in stages.

As described above, the method of this invention enables one to make the setting and changing of each composition ratio very easy and certain by inserting the composite into the sheathing element wherein the Ti lineal element and the Ni material of the required quantity are made to contact each other by making both contact through covering or intertwisting. In addition, it can repress the scattering of the composition in the interior of the alloy and the variations of the properties of the product.

Furthermore, because each of the above-mentioned lineal elements may be made into a minute line up to the fibrous shape by diameter-reducing working, it becomes possible not only to shorten the dispersing time significantly, but also to set freely the form and size of the alloy to be obtained in a wide range.

On the other hand, the Ti material has the disadvantage of being able to permit the oxide film to generate on the surface while working. However, it is possible for this invention to restrain the oxidation and to conduct the heat treatment in the atmosphere, because the working is practicable under the cover of the sheathing element. Further, in manufacturing the Ti element, it is not necessary to provide any large-scale equipment, because it is possible to prevent the mixture of any impure gas and to manufacture irrespective of the turnout. The manufacture by the use of the method of this invention has many positive effects such as a good yield rate, lowering of the production costs, enhancement of the homogeneity of the product, and so on.

Figure 31:
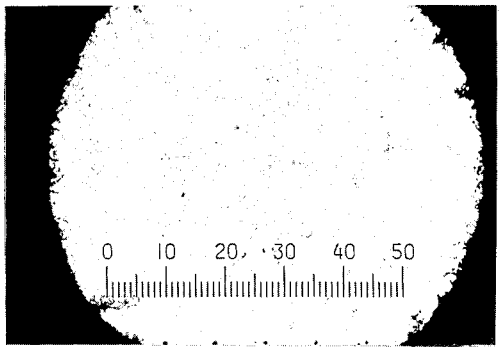
FIG. 31 is a microphotograph showing a metal tissue of a product obtained by the method of the claimed invention.
Figure 32:
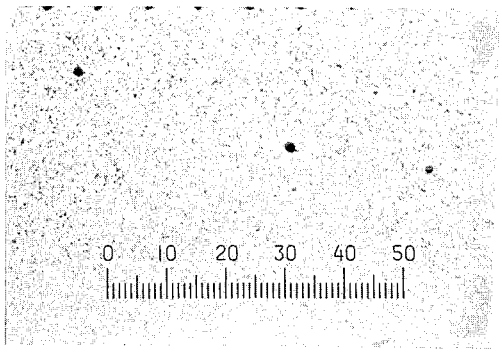
FIG. 32 is a microphotograph showing a metal tissue of the product obtained by conventional manufacturing methods.

The TiNi alloy obtained on the basis of the method of this invention has a pure and clean tissue free of oxide as understood from FIG. 31, wherefore it was possible to obtain the alloy of very small hysteresis.

The TiNi alloys conducted through the secondary diameter-reducing process shown in FIGS. 7 through 9 have better properties, such as mechanical strength, life time, and so on. As the features of the super-elastic alloy, δM, δR and hysteresis as well as the rate of the energy loss are improved. Further, the shape-memory property and the recovery stress in addition to the speed of response are also improved. Additionally, thermal fatigue life property becomes stable. Consequently, small sized ones may be available, and thereby the cost of the material is reduced.

This invention will be now explained in greater detail based upon the following Examples.

EXAMPLE 1

On the surface of the pure Ti lineal element 2 of 0.3 mm in diameter was conducted the Ni plating of about 40 μm in thickness, and then 490 pieces of the compound wire 6 having the Ni composition ratio of about 49% were inserted into the sheathing element stuff 7 made of the soft steel pipe of 12 mm in outer diameter, 10 mm in inner diameter and 1 m in length. In this way, there was obtained the composite 9. On this composite 9 was conducted the reducing working by means of cold wire-stretching machine.

At this time, it is ascertained that the cross sectional area of the compound wire 6 is of about 0.33 $mm^2$. and the Ti lineal wire becomes fibrous in shape of about 46 μm in diameter. The compound wires 6, being pressure welded, were one with each other due to the unevenness of the surfaces thereof even after the removal of sheathing element 7, and thereby they formed the compound material 10 without any voids.

A suitable fluid which can solve the sheathing element 7 not affecting the compound material 10 held therein is used for the removal of the sheathing element 7.

EXAMPLE 2

The compound material 10 obtained in Example 1 was heat-treated in a vacuum furnace at 1000° C. for 20 hours, and the internal Ni and Ti materials were made to diffuse, whereby the alloy having TiNi phase and Ni 49.1% was obtained.

The composition ratio is essentially the same as that of the materials, and therefore, it is seen that the ratio is maintained through the working processes.

After bending this up to an angle of about 90 degrees, when applying heat to it, it recovered to the original straight shape. The shape-memory properties are listed in Table 1 below.

TABLE 1

| | |
|---|---|
| Ni composition ratio | 49.1% |

TABLE 1-continued

| | |
|---|---|
| As point | 76° C. |
| Ms point | 72° C. |
| hysteresis As—Ms | 4° C. |

EXAMPLE 3

190 pieces of the compound material (A) obtained in Example 1 having a 0.6 mm diameter and another compound material (B) having the same diameter and Ni 52% formed similarly are disposed uniformly in a soft steel pipe as mentioned in Example 1, at a 1:1 ratio. The composite was drawn down to a 5.0 mm outer diameter by means of a cold extruder, and then the sheathing element was removed. The thus worked compound materials were adhered closely to each other. By applying heat to this composite at 900° C. for 10 hours, it was possible to obtain a NiTi alloy having Ni 50.5% and the properties in Table 2.

TABLE 2

| | |
|---|---|
| As point | 66° C. |
| Ms point | 64° C. |
| hysteresis As—Ms | 2° C. |

EXAMPLE 4

On the surface of the pure Ti lineal element 2 of 4 mm in diameter was disposed pure Ni by cladding of 0.55 mm in thickness, and then 24 pieces of the compound wires 6 were placed in the pipe made of soft steel (30 mm in inner diameter and 40 mm in outer diameter). The composite 9 is deformed in the shape of a hoop of 3 mm in thickness and of 60 mm in width. By removing the sheathing element, i.e., the pipe, the hoop-shaped compound material which is quite thin and adhered tightly with each other was manufactured. The surface thereof is uneven. Although the composite 9 is thinned in the total working ratio of 99.8%, it was able to be bent up to an angle of about 90 degrees without being cracked.

EXAMPLE 5

By inserting 500 pieces of compound wire 6 obtained through twisting the Ti lineal element 2 of 0.18 mm in diameter and the Ni lineal element 8 of 0.2 mm in diameter together in the ratio of 2:1 into the sheathing element 7 in a substantially parallel relationship having the outer diameter of 12 mm and the thickness of 1 mm which is made of soft steel, the composite 9 was formed. The composite 9 was drawn of a working ratio of 99.8% down to the elongated wire having a 0.6 mm diameter, and thereby removing the sheathing element 7, the compound material 10 is obtained in which the Ti and Ni lineal element 2, 5 became fibrous in shape of which the cross sectional area is about $2\times10^{-4}$ mm$^2$. The Ni composition ratio 49.8% was maintained through the processes. The compound material 10 was able to be bent up to 90 degrees by means of the pitcher without cracking, enabling bending up to larger angle.

EXAMPLE 6

The compound material obtained in Example 5 being diffused in a vacuum furnace at 1000° C. for 10 hours became a TiNi alloy in which the Ni and the Ti were well diffused.

It was ascertained that the NiTi alloy had a shape-memory ability in which the original shape was recovered by heating. The properties thereof are listed in Table 3.

TABLE 3

| | |
|---|---|
| Ni composition ratio | 49.8% |
| As point | 68° C. |
| Ms point | 55° C. |
| hysteresis As—Ms | 2° C. |

EXAMPLE 7

160 pieces consisting of 80 pieces of the compound material obtained in Example 5 having Ni 49.8% and 80 pieces of the compound material similarly processed having Ni 54% were disposed in the pipe made of soft steel uniformly. The composite was drawn to a final size wherein the compound materials have a diameter of 1 mm by means of an extruder. The compound material was bonded as a firm unit after the removal of the sheathing element. The compound material was subjected to a heating treatment at 900° C. for 20 hours, whereby the alloy having an Ni composition ratio of 52% was obtained.

EXAMPLE 8

By inserting 1000 pieces comprising Ti lineal element of 1 mm diameter and Ni lineal element having about the same diameter together in the ratio 1:1 and alternatively, into a square pipe having a 30 mm side length made from soft steel, the composite 9 was obtained. The composite 9 was deformed into a hoop-shape through the cold-rolling process in a rolling ratio of 99.998%.

As a result of microscopic inspection, it was seen that the cross sectional area is reduced to $8\times10^{-4}$ mm$^2$, and unevenness was found on the surfaces thereof. The compound materials were supposed to be firmly pressure welded, since after the bending test up to 180 degrees by the pitcher, there were not any cracks thereon.

EXAMPLE 9

By twisting uniformly 100 pieces of Ti lineal element of 1 mm diameter, 65 pieces of Ni lineal element of 1 mm diameter and 100 pieces of Cu lineal element of 0.2 mm diameter, a strand of compound wire was made. 50 pieces of the compound wire were disposed in the pipe in a length of 1000 mm. The composite 9 was cold-drawn at the working rate of 98% and a heat-treatment at 900° to 1000° C. was conducted. Prior to the heat-treatment, the sheathing pipe was removed.

As a result, there was obtained the TiNi alloy of 43% Ti-54% Ni-3% Cu and the hysteresis of which is 4° C.

EXAMPLE 10

On the surface of the pure Ti lineal element 2 of 0.47 mm in diameter was conducted the Ni plating of about 65 μm in thickness, and then 70 pieces of the compound wire 6 constituting the Ni composition ratio of 50% were inserted into the sheathing element 7 made of the soft steel pipe of 8 mm in outer diameter, 6 mm in inner diameter, and 1000 mm in length. In this way, there was obtained the composite 9. On this compound body 2 was conducted the reducing working in a working ratio of 10 to 20% per die, amounting to 99.7% in total by means of a cold wire-stretching machine.

At this time, the above-mentioned Ti core material holds 2.5 μm, and the thickness of the surface Ni plating preserves 17 to 19 μm, both in the nearly same composition ratio as the state of their own raw materials, while each covering element 4 adheres closely without a gap and with certainty.

On the thus worked composite 9 was conducted the heating treatment at 900° C. for 10 hours in the atmosphere, and the internal Ni and Ti materials were made to diffuse, whereby the alloy having the TiNi phase was obtained. The above-mentioned sheathing element 7 was removed by means of a chemical method after the above heating treatment.

This straight TiNi alloy is of the thickness having the diameter of 0.3 mm. After bending this by hand up to an angle of about 90 degrees, when applying heat to it, it recovered to the original straight-line form.

EXAMPLE 11

Immediately after conducting the cold working in the working ratio of 25% on the TiNi alloy obtained in Example 10 to mold it into a sticky spring of an outer diameter of 4 mm, that TiNi alloy was made to remember the shape of a spring through a heat treatment at 450° C. for 10 minutes. After stretching this spring while giving a load of 8%, when putting it into hot water of 60° C., it recovered to its original form in a moment.

The result obtained by comparing this specimen in which the temperature of the transformation point was measured by a DSC thermometer with the shape-memory alloy of Ni 50% obtained by the dissolution method as a conventional method is listed in Table 4 as follows:

TABLE 4

| | The present invention | Comparative case |
|---|---|---|
| Ni composition ratio | 50% | 50% |
| As point | 56° C. | 78° C. |
| Ms point | 50° C. | 60° C. |
| hysteresis As—Ms | 6° C. | 18° C. |

EXAMPLE 12

The composite 9 was obtained by inserting 160 pieces of compound wire 6 obtained through twisting the Ti lineal element 2 of 0.18 mm in diameter and the Ni lineal element 5 of 0.20 mm in diameter together in the ratio of 2:1 into the sheathing element 7 made of soft steel pipe.

As the result of conducting the wire-stretching working of the working ratio of 99.9% thereon, the internal Ti lineal element 2 and Ni lineal element 5 became fibrous in shape of about 6 μm, and they were both obtained in a state of having adhered closely without any substantial gap.

By applying heat to this composite 9 made into a small diameter at 900° C. for 8 hours, it was possible to obtain a shape-memory alloy having a TiNi phase of the Ni composition ratio of 48%. The tissue state of its cross-section at that time is shown in FIG. 31, while there are listed its shape-memory properties in Table 5 below.

In this connection, although this material was put to the bending test close to 180° C. by the method stipulated in JIS-Z-2448, no external defects appeared.

TABLE 5

| In the state of 900° C. × 30 min. | |
|---|---|
| As point | 84° C. |
| Ms point | 76° C. |

TABLE 5-continued

| In the state of 900° C. × 30 min. | |
|---|---|
| hystereis | 8° C. |

EXAMPLE 13

By intertwisting into an aggregate while dispersing 16 pieces of the Ti lineal elements 2 of 0.094 mm in diameter, and 9 pieces of the Ni lineal elements 5 of 0.188 mm in diameter, and also 2 pieces of the Cu lineal elements of 0.092 mm in diameter, 27 pieces total, there was obtained one piece of the TiNi wire body 6.

50 pieces of the compound bodies as described above were inserted into the sheathing element 7 made of the soft steel pipe of 1 m in length to form the composite 9 on which were conducted the cold working in a working ratio 70% using a cold wire-stretching machine, and also the diffusing treatment in the form of the stage treatment at 900° C. to 1100° C. (for 10 hours total). After that, the above-mentioned sheathing element 7 was removed by a chemical method.

As a result, there was obtained a TiNi alloy of 49.% Ti-45.5 Ni-5Cu (%).

EXAMPLE 14

On the surface of the pure Ti lineal element 2 of 0.3 mm in diameter was conducted Ni electroplating of about 42 μm in thickness, and then the compound wire of Ni 50.8% was obtained. 70 pieces of the compound wire were clad by the Ni hoop 0.2 m in thickness and 10 mm wide and this composite was cold-drawn down to 0.5 mm in outer diameter. The first drawn composite had almost the same Ni composition ratio as that of the clad stuff. 300 pieces of the first drawn composite were placed in the sheathing pipe of soft steel, and this composite was drawn, and thereby the secondary drawn composite having a 1 mm outside diameter was obtained, in which the compound wire turned to fibrous material having 2 through 3 μm. The compound material in the sheathing element, being pressure-welded, maintained a one strand condition even after the removal of the sheathing element, facilitating the handling thereof. Then, the compound material was heat-treated in a vacuum furnace at a temperature of 900° C. for 10 hours insufficiently.

As illustrated in FIG. 25, the Ti material was surrounded by a hexagonal netlike layer comprising a TiNi layer, wherein the dimension of the hexagonal corresponded to the diameter of the re-drawn first drawn compound wire. The netlike layers were supposed to be a concentration gradient layer holding a Ti-Ni phase in which the Ni hoop material was not sufficiently diffused with the Ti material.

EXAMPLE 15

The TiNi alloy obtained in Example 14 was subjected to a forming process to reduce the diameter slightly and to a heat-treatment process to produce super-elastic properties, in which the AF point is 20° C. The tissue in cross section is shown in FIG. 26 and FIG. 27 shows the tissue in a longitudinal direction.

The property of super-elasticity was tested by means of the tension tester (Inctron Corp.). The test specimen held at a distance of 20 mm was released after conducting 5% pre-strain and measured the stress δM where the martensite causing stress begins to be formed and the stress δR where the adverse transformation begins to start after the releasing of the prestress. The test was performed at a temperature of 37° C. and the results of the testing are shown in Table 6 with the results of the comparative case 1 of the conventional NiTi alloy made by the melting methods.

COMPARATIVE EXAMPLE 1

A TiNi alloy obtained by a melting method and having Ni 55.7% was drawn at a reduction ratio of about 30% and was heat-treated at 500° C. for 2 hours. The NiTi alloy of which the Af point is 24° C. having 0.46 mm in diameter was produced.

TABLE 6

| Sample | Dia. (mm) | Af (°C.) | M (Kg/mm²) | R (kg/mm²) | Hysteresis (αm − αR) | Energy loss (αm − αR/αM) × 100 |
|---|---|---|---|---|---|---|
| Ex. 15 | 0.36 | 20 | 52.1 | 24.6 | 27.5 | 52.7(%) |
| Comp. 1 | 0.46 | 24 | 35 | 6.7 | 28.3 | 80.8% |

EXAMPLE 16

550 pieces of the compound wire in which the Ti lineal element was electroplated were inserted in the pipe of soft steel and then the composite was drawn at the total reduction ratio of about 99%, and thereby the drawn composite was formed, producing the drawn comound material having a Ni 54.8%. The pipe was removed from the drawn compound material by use of acid. With the removal of the sheathing elementstuff, the Ni materials were also solved in the acid (42% nitric acid for 30 minutes) and the Ti rich surplus layer was provided around the compound material. 120 pieces of the compound material, being twisted, were disposed in the sheathing pipe and, subsequently, the composite was drawn to 1.2 mm in diameter, producing a secondary compound material therein. After the removal of the sheathing element, the secondary compound material was heat-treated at a temperature of 1100° C.

Since the TiNi alloy thus obtained had the Af point that is at 108° C., it is obvious that the metal had a shape-memory property. The metal had a 0.9 mm diameter and the reinforcing layer as seen in FIG. 26 was produced in the cross-section thereof. The metal which was annealed was tested to investigate the shape-memory properties.

(A) Recovery stress

The test specimen of the TiNi alloy held at a distance of 20 mm and the yield stress was tested conducting 3.3% strain thereon. After releasing the pre-strain, the recovery stress acting in a contracting direction was measured by blowing it into the wind at a temperature of 130° C. The result is shown in Table 7.

(B) Thermal fatigue

Figure 29:
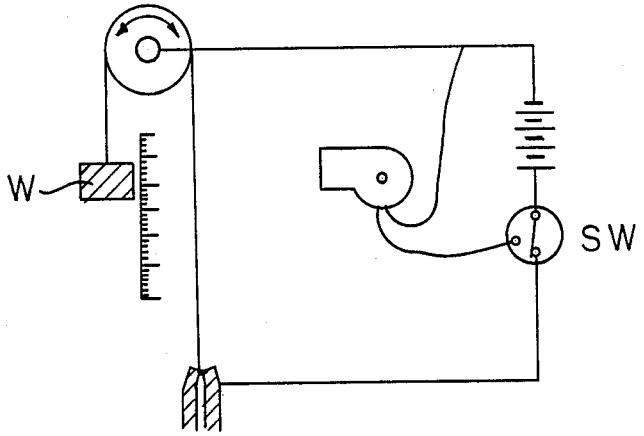
FIG. 29 is a schematic illustration showing a measuring instrument.
Figure 30:
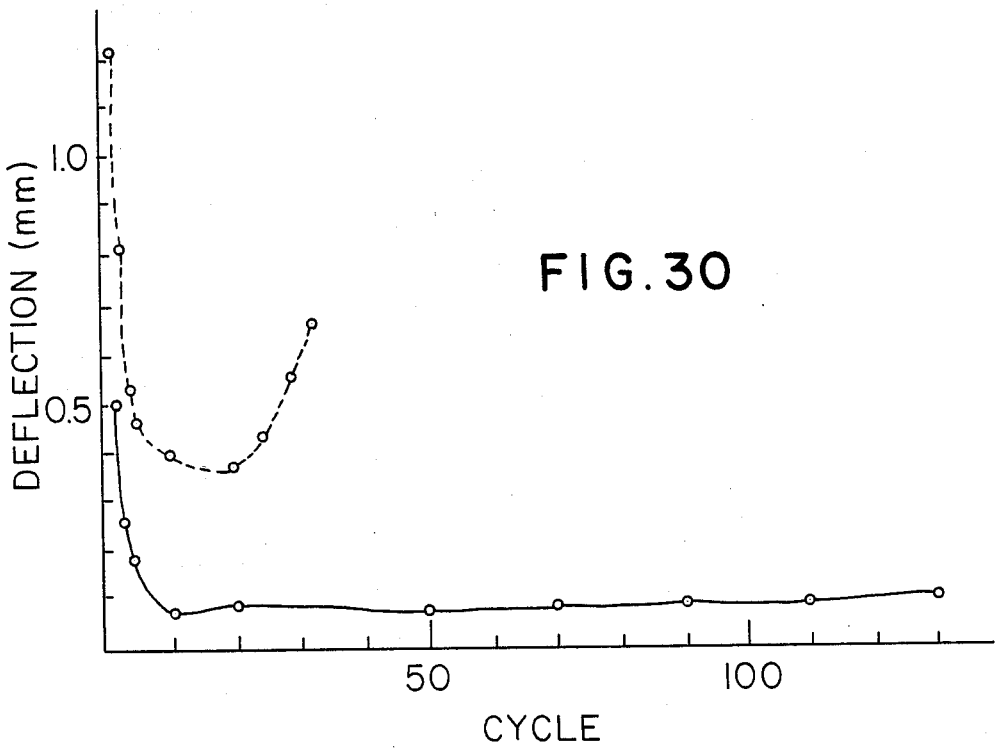
FIG. 30 is a graphical representation showing the relationship between the cycles and displacement of TiNi-alloys according to the invention.

FIG. 29 shows the testing instrument. The one end of the specimen which is the annealed TiNi alloy was fixed and the weight W is applied at the other end thereof. On the specimen, the cycle consisting of a heating step at a temperature of 130° C. by the battery and a cooling step at a temperature of 20° C. by an electric fan, is affected repeatedly at 10 second intervals. The reflection at the other end was measured and illustrated in FIG. 30 by a solid line.

COMPARATIVE EXAMPLE 2

TiNi alloy obtained by the conventional melting method was cold-drawn down to 1.14 mm in diameter, and it was heat-treated at a temperature of 900° C. for 30 minutes. The thus obtained TiNi alloy had a shape-memory property having an Af point of 107° C.

TABLE 7

| Sample | Dia. (mm) | Af point (°C.) | Yield stress (Kg/mm²) | Recovery stress (Kg/mm²) | Loss (Kg/mm²) |
|---|---|---|---|---|---|
| Ex. 16 | 0.9 | 108 | 17.2 | 18.2 | 0 |
| Comp. 2 | 1.14 | 107 | 14.7 | 6.9 | 7.8 |

What is claimed is:

1. A method of making TiNi-alloys comprising the steps of:

forming a composite by providing in a sheathing container plural sections of a compound wire comprising Ti lineal wire made of Ti material and Ni material made to contact at least a portion of the surface of said Ti lineal wire, wherein said compound wire has a Ni content of at least 45 to 60% by weight;

reducing the dimension of said composite so as to reduce said compound wire therein;

effecting a diffusion process on said composite to cause a TiNi phase to be produced by a diffusion reaction;

removing said sheathing container from said composite during said diffusion step or after said diffusion step; and cold-working said composite to form a TiNi alloy.

2. The method of claim 1, wherein said compound wire comprises one or more elements selected from the group consisting of Cu, V, Mo, Cr, Al, Co, and Fe.

3. The method of claim 1, wherein said Ni material is in a form of an elongated Ni lineal element.

4. The method of claim 3, wherein said Ni lineal element contacts the surface of said Ti lineal wire by twisting with each other.

5. The method of claim 4, wherein the number of twists is 0.5 to 5 per inch.

6. The method of claim 1, wherein said diffusion is effected by heating at a temperature of 700° to 1100° C.

7. The method of claim 6, wherein said temperature is varied in stages.

8. The method of claim 1, wherein said Ti lineal wire has a diameter of about 0.05 to 5 mm.

9. The method of claim 1, wherein said Ni material contacts the surface of said Ti lineal wire by being plated thereon.

10. The method of claim 1, wherein said Ni material contacts the surface of said Ti lineal wire by means of cladding of pipe material or hoop material made of Ni.

* * * * *